US012729597B2

(12) United States Patent
Olson et al.

(10) Patent No.: US 12,729,597 B2
(45) **Date of Patent: *Sep. 8, 2026**

(54) CLOSING UNIT SYSTEM FOR A BLOWOUT PREVENTER

(71) Applicant: Schlumberger Technology Corporation, Sugar Land, TX (US)

(72) Inventors: Matthew Olson, Cypress, TX (US); Stephen McGuire, Hockley, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/928,348

(22) Filed: Oct. 28, 2024

(65) Prior Publication Data

US 2025/0052127 A1 Feb. 13, 2025

Related U.S. Application Data

(63) Continuation of application No. 18/329,235, filed on Jun. 5, 2023, now Pat. No. 12,129,730, which is a continuation of application No. 16/996,479, filed on Aug. 18, 2020, now Pat. No. 11,708,738.

(51) Int. Cl.

| | |
|---|---|
| ***E21B 33/06*** | (2006.01) |
| ***F04B 17/03*** | (2006.01) |
| ***F04B 23/04*** | (2006.01) |

(52) U.S. Cl.

CPC ..... *E21B 33/063* (2013.01); *F04B 17/03* (2013.01); *F04B 23/04* (2013.01)

(58) Field of Classification Search

CPC .... E21B 33/063; E21B 33/03; E21B 33/0355; E21B 33/06; E21B 33/064; E21B 34/16; F04B 17/03; F04B 23/04; F04B 23/02; F04B 49/007; F04B 49/065; F04B 49/106

See application file for complete search history.

(56) References Cited

U.S. PATENT DOCUMENTS 12,129,730 B2 * 10/2024 Olson ..... E21B 33/06
2018/0243257 A1 8/2018 Levitin

FOREIGN PATENT DOCUMENTS

JP 2001165105 A 6/2001

* cited by examiner

*Primary Examiner* — James G Sayre
(74) *Attorney, Agent, or Firm* — Kelly C. Brewerton

(57) ABSTRACT

A closing unit system for a blowout preventer (BOP) stack includes a fluid reservoir that stores a fluid at atmospheric pressure, at least one pump system fluidly coupled to the fluid reservoir, and at least one power source electrically coupled to the at least one pump system. At least one valve of the closing unit system is fluidly coupled to the at least one pump system and to an actuator associated with the BOP stack. The closing unit system also includes one or more processors configured to receive at least one input indicative of an instruction to control the actuator, and instruct the at least one power source to provide power to the at least one pump system to cause the at least one pump system to pump the fluid from the reservoir to the at least one valve in response to the at least one input.

17 Claims, 4 Drawing Sheets

CLOSING UNIT SYSTEM FOR A BLOWOUT PREVENTER

CROSS-REFERENCE TO RELATED APPLICATIONS

This application claims priority as a continuation application of U.S. patent application Ser. No. 18/329,235, titled "CLOSING UNIT SYSTEM FOR A BLOWOUT PREVENTER," filed Jun. 5, 2023, which is a continuation application of U.S. patent application Ser. No. 16/996,479, titled "CLOSING UNIT SYSTEM FOR A BLOWOUT PREVENTER," filed Aug. 18, 2020. These priority applications are incorporated by reference herein in their entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) stack is installed on a wellhead to seal and control an oil and gas well during various operations. For example, during drilling operations, a drill string may be suspended from a platform through the BOP stack into a wellbore. A drilling fluid is delivered through the drill string and returned up through an annulus between the drill string and a casing that lines the wellbore. In the event of a rapid invasion of formation fluid in the annulus, commonly known as a "kick," a BOP of the BOP stack may be actuated to seal the annulus and to control fluid pressure in the wellbore, thereby protecting well equipment positioned above the BOP stack. A closing unit system is provided to control operation of the BOP stack.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
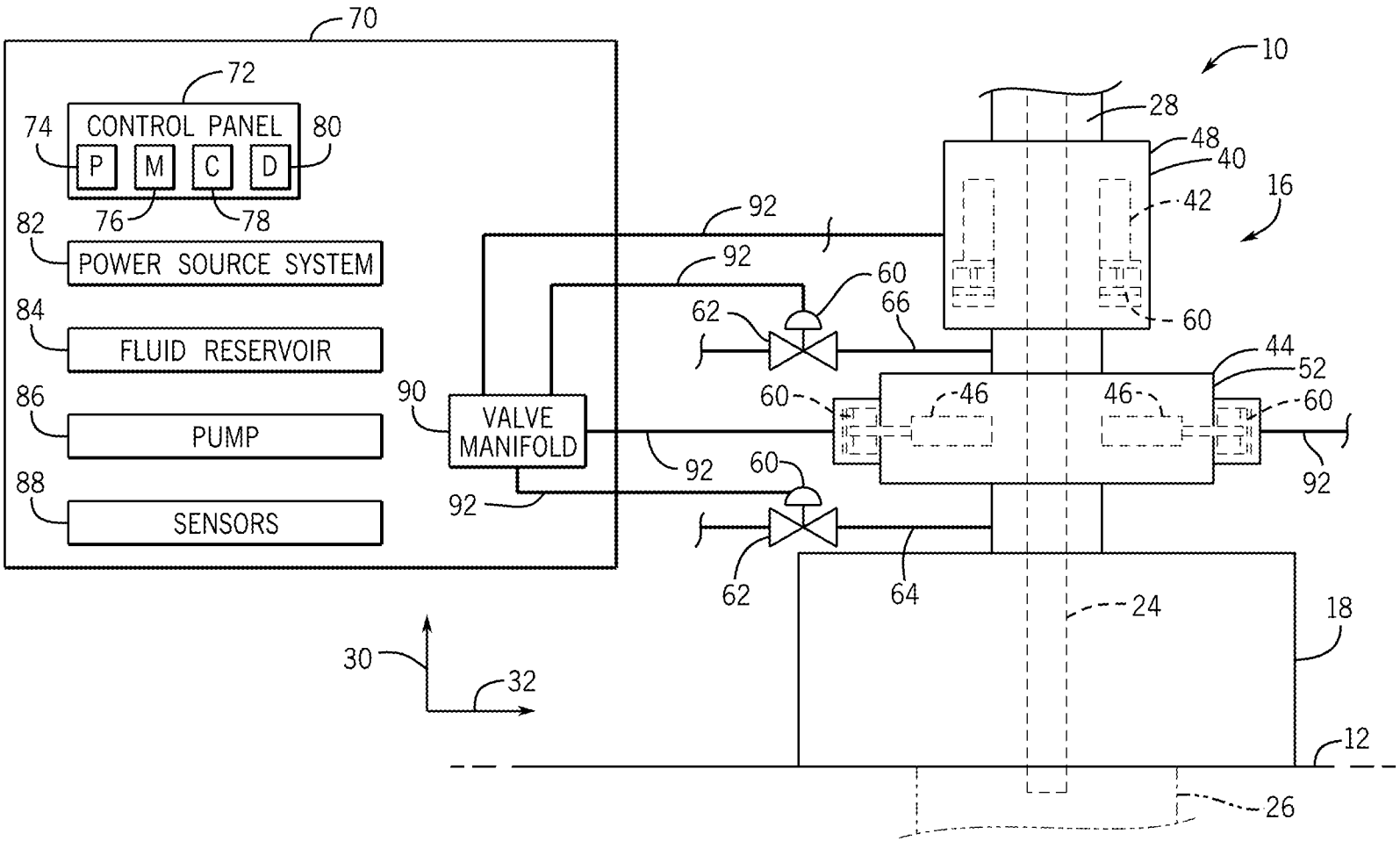
FIG. 1 is a schematic diagram of an embodiment of a portion of a mineral extraction system having a closing unit system and a blowout preventer (BOP) stack.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments generally relate to a closing unit system for a blowout preventer (BOP) stack. The BOP stack may include one or more actuatable devices, such as one or more annular BOPs and/or one or more ram BOPs. For example, each of the one or more annular BOPs may include an annular seal element that is driven radially-inwardly to seal against a conduit within a central bore of the BOP stack or to seal against itself across the central bore of the BOP stack, and each of the one or more ram BOPs may include opposed rams that move toward one another to seal against the conduit and/or to seal against one another across the central bore of the BOP stack. In this way, the one or more annular BOPs and/or the one or more ram BOPs may adjust between an open position and a closed position. It should be appreciated that the BOP stack may include various other types of actuatable devices, such as valves that adjust fluid flow through a choke line and/or a kill line, for example. Furthermore, the one or more actuatable devices of the BOP stack may have any of a variety of configurations (e.g., a ram BOP having only a single ram).

The BOP stack may include one or more actuators to adjust the one or more actuatable devices. For example, each annular BOP may include an annular BOP actuator that is configured to drive the annular seal element radially-inwardly to adjust the annular BOP to the closed position. Similarly, each ram of each ram BOP may be coupled to a ram BOP actuator that is configured to drive the ram to adjust the ram BOP to the closed position. The one or more actuators may be hydraulic actuators that are driven via a hydraulic fluid. The closing unit system of the present disclosure may be configured to reliably provide the hydraulic fluid at a high pressure to the one or more actuators to adjust the one or more actuatable devices, such as to drive the one or more annular BOPs and/or the one or more ram BOPs to the closed position.

The closing unit system of the present disclosure may include a control panel, at least one fluid reservoir, at least one pump, at least one power source (e.g., having a rechargeable power storage device, such as a battery), at least one sensor, and at least one valve manifold. In response to receipt of an input that indicates that at least one actuatable device of the BOP stack should be adjusted, the at least one power source may provide power to the at least one pump, which pumps the hydraulic fluid from the at least one fluid reservoir through the at least one valve manifold that routes the hydraulic fluid to the one or more actuators for the at least one actuatable device. As discussed in more detail below, the closing unit system may include multiple fluid reservoirs that are each coupled to multiple pumps that are each configured to be powered by multiple power sources.

The at least one sensor may be used to monitor operation of the closing unit system, and the closing unit system may be configured to initiate a corrective action in response to data from the at least one sensor indicating improper operation of the closing unit system. For example, in response to the data from the at least one sensor indicating improper parameter(s) of the hydraulic fluid pumped by a first pump of the closing unit system, the closing unit system may turn off the first pump of the closing unit system and turn on a second pump of the closing unit system. In this way, the closing unit system provides redundancy to reliably provide the hydraulic fluid to the one or more actuators of the BOP stack.

The at least one fluid reservoir and the at least one pump of the closing unit system of the present disclosure may be used instead of accumulators that store high pressure accumulator hydraulic fluid. The closing unit system may transfer the hydraulic fluid from the at least one fluid reservoir (e.g., which stores the hydraulic fluid at atmospheric pressure or at a first pressure) to the at least one pump when the at least one pump is turned on in response to the input that indicates that at least one actuatable device of the BOP stack should be adjusted. The closing unit system may then transfer the hydraulic fluid (e.g., now at high pressure or at a second pressure that is higher than the first pressure) from the at least one pump to the at least one valve manifold, which directs the hydraulic fluid to the one or more actuators of the BOP stack. Thus, the closing unit system may provide the hydraulic fluid on demand and as needed by the BOP stack.

In some embodiments, the closing unit system may be devoid of accumulators that store high pressure accumulator fluid. However, in some embodiments, the accumulators may be utilized to store and to provide the high pressure accumulator fluid for certain actuators (e.g., only for some of the one or more actuators of the BOP stack), such as the valves for the choke line and/or the kill line associated with the BOP stack. In some such embodiments, the accumulators may not be utilized to store and to provide the high pressure accumulator fluid to the one or more actuators for the one or more annular BOPs and/or the one or more ram BOPs of the BOP stack, such as for a shear ram BOP of the BOP stack. In some embodiments, the accumulators may be utilized to store and to provide the high pressure accumulator fluid to the one or more actuators for the one or more annular BOPs and/or the one or more ram BOPs of the BOP stack as a backup to the hydraulic fluid that is provided via the at least one pump (e.g., via control of the at least one valve manifold). It should be appreciated that various other arrangements are envisioned. For example, in some embodiments, the at least one pump may be utilized to provide the hydraulic fluid only for the shear ram BOP of the BOP stack, while the accumulators may be utilized to store and to provide the high pressure accumulator fluid for the other actuatable devices of the BOP stack.

While the disclosed embodiments are described in the context of a drilling system and drilling operations to facilitate discussion, it should be appreciated that the BOP stack may be adapted for use in other contexts and during other operations. For example, the BOP stack may be used in a pressure control equipment (PCE) stack that is coupled to and/or positioned vertically above a wellhead during various intervention operations (e.g., inspection or service operations), such as wireline operations in which a tool supported on a wireline is lowered through the PCE stack to enable inspection and/or maintenance of a well. In the present disclosure, a conduit may be any of a variety of tubular or cylindrical structures, such as a drill string, wireline, Streamline™, slickline, coiled tubing, or other spoolable rod.

With the foregoing in mind, FIG. 1 is a schematic diagram of an embodiment of a mineral extraction system 10. The mineral extraction system 10 may be configured to extract various minerals and natural resources, including hydrocarbons (e.g., oil and/or natural gas), from the earth or to inject substances into the earth. As shown, the mineral extraction system 10 is a land-based system or a surface system; however, certain features of the embodiments disclosed herein may be used in an offshore system. In FIG. 1, a BOP stack 16 is mounted to a wellhead 18, which is coupled to a mineral deposit via a wellbore 26. The wellhead 18 may include or be coupled to any of a variety of other components such as a spool, a hanger, and a "Christmas" tree. Downhole operations are carried out by a conduit 24 (e.g., drill string) that extends through a central bore 28 (e.g., flow bore) of the BOP stack 16, through the wellhead 18, and into the wellbore 26.

To facilitate discussion, the BOP stack 16 and its components may be described with reference to a vertical axis or direction 30 and/or a lateral axis or direction 32. The BOP stack 16 may include one or more actuatable devices, such as one or more BOPs stacked along the vertical axis 30 relative to one another. The one or more BOPs may include an annular BOP 40 that includes an annular seal element 42 that is driven radially-inwardly to seal the central bore 28 and/or a ram BOP 44 that includes opposed rams 46 that move toward one another to seal the central bore 28. In this way, each of the one or more BOPs may move between an open position and a closed position. In the open position, the one or more BOPs may enable fluid flow through the central bore 28. In the closed position, the one or more BOPs may block fluid flow through the central bore 28. More particularly, while the annular BOP 40 is in the open position, the annular sealing element 42 is withdrawn into a cavity within an annular BOP housing 48, does not extend into the central bore 28, and/or does not contact the conduit 24. However, while the annular BOP 40 is in the closed position, the annular sealing element 42 extends into the central bore 28 and/or contacts the conduit 24. Similarly, while the ram BOP 44 is in the open position, the opposed rams 46 are withdrawn into cavities within a ram BOP housing 52, do not extend into the central bore 28, do not contact the conduit 24, and/or do not contact one another. However, while the ram BOP 44 is in the closed position, the opposed rams 46 extend into the central bore 28, contact the conduit 24, and/or contact one another. The annular BOP housing 48 and the ram BOP housing 52 may be coupled to one another (e.g., via one or more fasteners) to form a BOP stack housing (e.g., multi-part housing).

While the illustrated BOP stack 16 includes one annular BOP 40 and one ram BOP 44 to facilitate discussion, it should be appreciated that the BOP stack 16 may include any suitable number of the BOPs (e.g., 1, 2, 3, 4, or more BOPs). Additionally, the BOP stack 16 may include any of a variety of different types of BOPs (e.g., one or more annular BOPs 40 and/or one or more ram BOPs 44, which may have shear rams, blind rams, blind shear rams, pipe rams). For example, in certain embodiments, the BOP stack 16 may include two annular BOPs 40 stacked above one ram BOP 44 having opposed shear rams 46 configured to sever the conduit 24 to block fluid flow through the central bore 28 and one ram BOP 44 having opposed pipe rams 46 configured to engage the conduit 24 to block fluid flow through the central bore 28 (e.g., through an annulus about the conduit 24).

As shown, the BOP stack 16 also includes or is associated with one or more actuators 60 (e.g., hydraulic actuators; actuator assemblies). For example, the annular BOP 40 may include one actuator 60 that is supported within the annular BOP housing 48 and that is configured to drive the annular sealing element 42, and the ram BOP 44 may include multiple actuators 60 (e.g., one actuator 60 for each of its opposed rams 46). Each actuator 60 may include a piston that is configured to move within a cylinder in response to a force exerted against the piston by a hydraulic fluid. In the annular BOP 40, the piston may be an annular piston that is coupled via a connecting rod to an annular push plate, and the annular push plate may contact and drive the annular sealing element 42. In the ram BOP 44, the piston may be coupled via a connecting rod to the respective ram 46 to drive the respective ram 46. However, it should be appreciated that the one or more actuators 60 may have any of a variety of configurations. Additionally, the BOP stack 16 may include various other actuatable devices, such as one or more valves 62 (e.g., normally-open valves) that may adjust (e.g., enable or block) fluid flow through a choke line 64 and/or a kill line 66. In such cases, respective actuators 60 may be provided to control the one or more valves 62 for the choke line 64 and/or the kill line 66.

A closing unit system 70 (e.g., fluid delivery system) may provide the hydraulic fluid to control the one or more actuators 60 associated with the BOP stack 16. The closing unit system 70 may include a control panel 72, which may include a processor 74, a memory device 76, a communication device 78, and/or a display 80. The closing unit system 70 may also include one or more power source systems 82, one or more fluid reservoirs 84, one or more pumps 86 (e.g., pump system; one or more electric pumps with one or more drive mechanisms, such as one or more electric motors), one or more sensors 88, and one or more valve manifolds 90.

In operation, the control panel 72 may receive an input (e.g., from an operator and/or from one or more sensors, such as from one or more pressure sensors exposed to the central bore 28 of the BOP stack 16). The control panel 72 may process the input to determine whether to actuate any of the actuatable devices of the BOP stack 16. For example, in response to receipt of the input indicating a request to initiate a test procedure or indicating a surge in pressure within the central bore of the BOP stack 16, the control panel 72 may instruct the one or more power systems 82 to deliver power to the one or more pumps 86. Then, the one or more pumps 86 may pump the hydraulic fluid from the one or more fluid reservoirs 84 to the one or more valve manifolds 90. In particular, the hydraulic fluid may be stored in the one or more fluid reservoirs 84 at a first pressure (e.g., atmospheric pressure), and the one or more pumps 86 may output the hydraulic fluid at a second pressure that is higher than the first pressure (e.g., more than 30, 40, 50, 60 Megapascals). The one or more pumps 86 may be operated to output the hydraulic fluid with target parameter(s) (e.g., at a target pressure, volume, flow rate) that are appropriate and sufficient to control the one or more actuators 60 of the BOP stack 16. In some embodiments, the one or more pumps 86 may be variable output pumps that are controlled by the control panel 72 to provide the hydraulic fluid with the target parameter(s). In some such cases, the target parameter(s) may be determined and/or stored by the control panel 72 and may vary based on various factors, such as the components of the BOP stack 16 to be actuated, the pressure within the central bore of the BOP stack 16, or the like, which may be received as inputs at the control panel 72. In some embodiments, because the one or more pumps 86 may output the hydraulic fluid with the target parameter(s), the closing unit system 70 may be devoid of a regulator (e.g., pressure regulator) between the one or more valve manifolds 90 and the BOP stack 16.

Each of the one or more valve manifolds 90 may include various types of valves (e.g., solenoid valves; diverter valves) that are controlled by the control panel 72 to direct the hydraulic fluid from the one or more pumps 86 through respective hoses 92 (e.g., flexible hoses; rigid pipes; conduits) to an appropriate actuator(s) of the one or more actuators 60 of the BOP stack 16 (e.g., to cause a desired actuation or adjustment of the BOP stack 16, such as to close the ram BOP 44). In this way, the closing unit system 70 may generate and provide the hydraulic fluid at high pressure on demand (e.g., in response to the input) for the one or more actuators 60 of the BOP stack 16. Advantageously, the closing unit system 70 may therefore not include and/or rely upon accumulators that store high pressure accumulator fluid to carry out at least some operations of the BOP stack 16 (e.g., to adjust the annular BOP 40 and/or the ram BOP 44; to shear the conduit 24 via the ram BOP 44). Furthermore, as discussed in more detail below, the closing unit system 70 may also be arranged to limit hose material that supports and delivers the hydraulic fluid at high pressure (e.g., as compared to some existing systems that use the accumulators to store and provide the high pressure accumulator fluid to the BOP stack 16 and that do not include the one or more pumps 86 and related components disclosed herein). The closing unit system 70 may be particularly useful where the hydraulic fluid is provided to the BOP stack 16 at very high pressures, such as to shear the conduit 24 during very high pressures within the wellbore 26, because the closing unit system 70 may increase the pressure of the hydraulic fluid for delivery to the BOP stack 16 as needed (e.g., as opposed to storing and maintaining fluid at such high pressure within the accumulators, which may require that the accumulators be very large in size).

Figure 2:
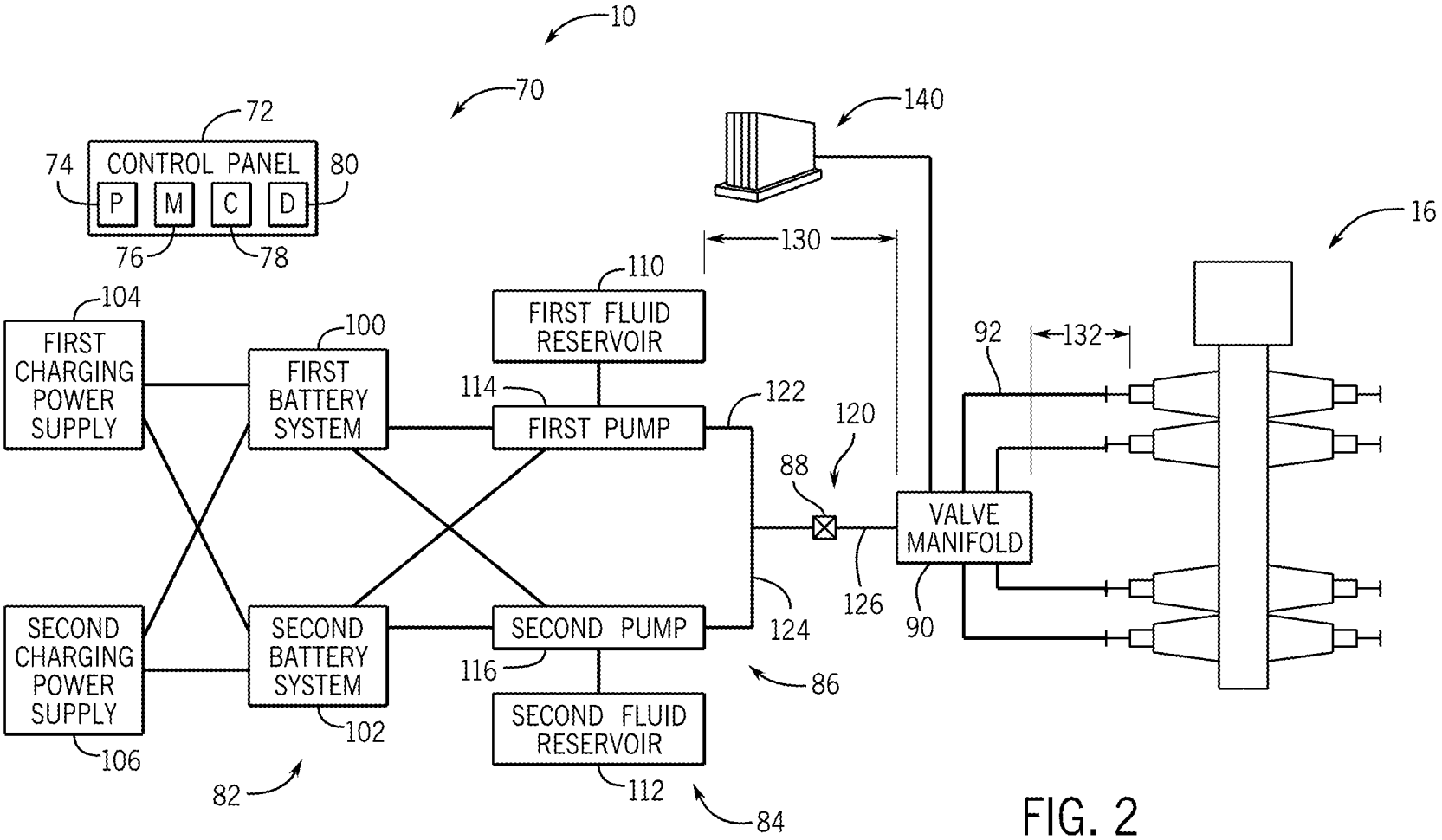
FIG. 2 is a schematic diagram of an embodiment of the closing unit system that may be used in the mineral extraction system of FIG. 1.

FIG. 2 is a schematic diagram of an embodiment of the closing unit system 70 that may be used to control operation of the BOP stack 16. In FIG. 2, the closing unit system 70 includes a redundant arrangement to enable the closing unit system 70 to reliably provide the hydraulic fluid to the BOP stack 16. The closing unit system 70 may include the control panel 72. The closing unit system 70 may also include the one or more power source systems 82, which may include a first battery system 100 (e.g., having a first rechargeable power storage device, such as a battery; a power management system) and a second battery system 102 (e.g., having a second rechargeable power storage device, such as a battery; a power management system).

The one or more power source systems 82 may further include or be coupled to a first charging power supply 104 (e.g., a rig power supply) and a second charging power supply 106 (e.g., diesel power supply). The first charging power supply 104 may be configured to charge the first battery system 100 and/or the second battery system 102. The second charging power supply 106 may be configured to charge the first battery system 100 and/or the second battery system 102. Thus, the closing unit system 70 may include redundancy with respect to power sources. For example, should the first battery system 100 fail (e.g., fail to hold a charge) or be otherwise unable to provide sufficient power to the one or more pumps 86, the second battery system 102 may be utilized to provide power to the one or more pumps 86. Additionally, should both the first battery system 100 and the second battery system 102 fail or be otherwise unable to provide sufficient power to the one or more pumps 86, the first charging power supply 104 and/or the second charging power supply 106 may be utilized to provide power to the one or more pumps 86. Furthermore, should the first charging power supply 104 fail or be otherwise unable to provide sufficient power to charge the first battery system 100 and/or the second battery system 102, the second charging power supply 106 may be utilized to provide power to charge the first battery system 100 and/or the second battery system 102. In some embodiments, the first battery system 100 and the second battery system 102 may run independently of the first charging power supply 104 and/or the second charging power supply 106 (e.g., when disconnected), and may be periodically charged and/or charged as needed. In some embodiments, additional battery systems and/or charging power supplies may be provided.

The closing unit system 70 may further include the one or more fluid reservoirs 84, which may include a first fluid reservoir 110 and a second fluid reservoir 112. The closing system 70 may additionally include the one or more pumps 86, which may include a first pump 114 and a second pump 116. The first fluid reservoir 110 may be fluidly coupled to the first pump 114, and the second fluid reservoir 112 may be fluidly coupled to the second pump 116. In some embodiments, the first fluid reservoir 110 may also be fluidly coupled to the second pump 116 and/or the second fluid reservoir 112 may also be fluidly coupled to the first pump 114. The first pump 114 and the second pump 116 may be electric pumps that are configured to pump the hydraulic fluid from one or both of the first fluid reservoir 110 and the second fluid reservoir 112 to the valve manifold 90. It should be appreciated that valves may be provided (and controlled via instructions from the control panel 72) to fluidly couple the first fluid reservoir 110 and/or the second fluid reservoir 112 to the first pump 114 and/or the second pump 116. In some embodiments, additional pumps may be provided, such as multiple first pumps 114 and/or multiple second pumps 116. Furthermore, each of the first pump(s) 114 and/or each of the second pump(s) 116 may be driven by one or more motors. Regardless of the configuration, the first pump(s) 114 and the second pump(s) 116 are configured to provide the hydraulic fluid with target parameter(s) to control the BOP stack 16.

As shown, the first battery system 100 may be configured to provide power to the first pump 114 and/or to the second pump 116, and the second battery system 102 may be configured to provide power to the first pump 114 and/or the second pump 116. Thus, the closing unit system 70 may include redundancy with respect to power sources, fluid reservoirs, and pumping components. For example, should the first pump 114 fail (e.g., a motor of the first pump 114 seizes) or be otherwise unable to provide the hydraulic fluid with the target parameter(s) for the BOP stack 16, the second pump 116 may then be utilized alone or in combination with the first pump 114.

As shown, the first pump 114 and the second pump 116 are fluidly coupled to one valve manifold 90 via one or more closing unit hoses 120 (e.g., closing unit hose assembly; flexible hoses; rigid pipes; conduits). In the illustrated embodiment, a first closing unit hose section 122 extends from the first pump 114 and a second closing unit hose section 124 extends from the second pump 116, and the first and second closing unit hose sections 122, 124 each flow into a third closing unit hose section 126 that extends to the valve manifold 90. However, the one or more closing unit hoses 120 may have any of a variety of other configurations. For example, in some embodiments, a first separate closing unit hose may run from the first pump 114 to the valve manifold 90, and a second separate closing unit hose may run from the second pump 116 to the valve manifold 90.

The one or more sensors 88 may be positioned at various locations about the closing unit system 70, such as along the one or more closing unit hoses 120. For example, the one or more sensors 88 may be configured to monitor parameter(s) (e.g., pressure) of the hydraulic fluid within the one or more closing unit hoses 120. The one or more sensors 88 may provide data (e.g., sensor signals) to the control panel 72, which may process the data to monitor the operation of the closing unit system 70 and to take one or more corrective actions to reliably provide the hydraulic fluid to the BOP stack 16.

For example, the control panel 72 may receive the data indicative of the parameter(s) and may compare the parameter(s) to the target parameter(s). In response to a difference between the flow parameter(s) and the target parameter(s) being above a difference threshold, the control panel 72 may initiate the one or more corrective actions. For example, the control panel 72 may adjust operation of the pump that is being utilized to pump the hydraulic fluid to the BOP stack 16 until the parameter(s) correspond to the target parameter(s) (e.g., feedback loop). In some embodiments, the control panel 72 may switch the pump (e.g., from the first pump 114 to the second pump 116, or vice versa) that is being utilized to pump the hydraulic fluid to the BOP stack 16 and/or add one or more additional pumps (e.g., use both the first pump 114 and the second pump 116) to pump the hydraulic fluid to the BOP stack 16.

It should be appreciated that the one or more sensors 88 may additionally or alternatively include other types of sensors that monitor other components of the closing control system 70. For example, the one or more sensors 88 may include sensors that are internal to the first pump 114 and the second pump 116 and that monitor pump operation (e.g., to detect stalled motors) and/or sensors that monitor the first battery system 100 and the second battery system 102 and that monitor a remaining charge, and the like. Then the control panel 72 may switch the pump (e.g., from the first pump 114 to the second pump 116, or vice versa) that is being utilized to pump the hydraulic fluid to the BOP stack 16 and/or may switch the battery system (e.g., from the first battery system 100 to the second battery system 102, or vice versa) that is being utilized to provide power to the pump(s). Regardless of the placement or type of the one or more sensors 88, the control panel 72 may receive respective data from the one or more sensors 88 and may initiate the one or more corrective actions to modify the operation (e.g., select which components to utilize and combine together; change a combination of components that are utilized together) to reliably provide the hydraulic fluid to the BOP stack 16 (e.g., with the target parameter(s)).

The control panel 72 may additionally or alternatively receive respective data from one or more sensors at the BOP stack 16 (e.g., coupled to a ram of the BOP stack 16; exposed to the central bore 28 of the BOP stack 16). The control panel 72 may take the one or more corrective actions in response to the respective data from the one or more sensors at the BOP stack 16 indicating that the one or more actuatable devices of the BOP stack 16 is not in a target position, such as the closed position (which in turn may indicate that the closing control system 70 is not delivering the hydraulic fluid at the target parameter(s) to move the one or more actuatable devices of the BOP stack 16 to the target position, for example).

It should be appreciated that the control panel 72 may be a controller (e.g., electronic controller). The control panel 72 may be a dedicated controller for the closing unit system 70 and/or the control panel 72 may be part of or include a distributed controller with one or more electronic controllers in communication with one another to carry out the various techniques disclosed herein. Furthermore, the one or more power sources 82, such as the first battery system 100 and the second battery system 102, may include processing and control components (e.g., one or more processors, one or more memory devices) that are configured to carry out some of the techniques disclosed herein (e.g., processing data indicative of a remaining charge and/or initiating a recharge process for the rechargeable battery in response to the remaining charge being below a charge threshold).

The processor 74 may also include one or more processors configured to execute software, such as software for processing signals and/or controlling the components of the closing unit system 70. The memory device 76 disclosed herein may include one or more memory devices (e.g., a volatile memory, such as random access memory [RAM], and/or a nonvolatile memory, such as read-only memory [ROM]) that may store a variety of information and may be used for various purposes. For example, the memory device 76 may store processor-executable instructions (e.g., firmware or software) for the processor 74 to execute, such as instructions for processing signals and/or controlling the components of the closing unit system 70. It should be appreciated that the control panel 72 may include various other components, such as the communication device 78 that is capable of receiving data (e.g., inputs) and/or communicating data (e.g., data obtained by the one or more sensors 88) and/or other information (e.g., which components of the closing unit system 70 are currently combined together to provide the hydraulic fluid to the BOP stack 16) to various other devices (e.g., a remote computing system located remotely from the closing unit system 70). The control panel 72 may also include the display 80, which may be configured to display data and/or other information locally at the control panel 72 for visualization by the operator. The display 80 may be a touchscreen that is capable of receiving inputs from the operator. However, it should be appreciated that the control panel 72 may be configured to receive inputs from the operator via other inputs devices (e.g., push buttons). Indeed, the control panel 72 may include any of a variety of input and/or output devices (e.g., lights, speakers, push buttons, the display 80) to receive and/or to provide data, information, and/or alerts to the operator.

As shown, the valve manifold 90 may be positioned proximate to the BOP stack 16. For example, a first distance 130 between the valve manifold 90 (e.g., inlet) and the one or more pumps 86 (e.g., outlet) may be greater than a second distance 132 between the valve manifold 90 (e.g., outlet) and the BOP stack 16 (e.g., inlet). In some embodiments, the valve manifold 90 may be supported on the BOP stack 16 (e.g., coupled to the BOP stack housing). Such placement of the valve manifold 90 may enable the use of less hose material (e.g., rated for high pressure) to deliver the hydraulic fluid at high pressure from the one or more pumps 74 to the BOP stack 16 (e.g., as compared to placement of the valve manifold 90 proximate to the one or more pumps 86 and remotely from the BOP stack 16). For example, in the configuration shown in FIG. 2, the third closing unit hose section 120 is a single long section that runs from the intersection of the first closing unit hose section 122 and the second closing unit hose section 124 to the valve manifold 90. The multiple hoses 92 that connect the valve manifold 90 to the BOP stack assembly 16 are shorter than the third closing unit hose section 122. However, if the valve manifold 90 were to be placed proximate to the one or more pumps 86 and remotely from the BOP stack 16, the third closing unit hose section 120 would be shorter and the multiple hoses 92 that connect the valve manifold 90 to the BOP stack assembly 16 would be longer, thereby resulting in the use of additional hose material to connect the one or more pumps 86 to the BOP stack 16. The hose material downstream of the one or more pumps 86 may be heavy, durable, and/or fire-proof, so the closing unit system 70 disclosed herein may result in cost savings (e.g., due to material costs and/or easier set up). In FIG. 2, only some of the multiple hoses 92 are illustrated for image clarity. Furthermore, it should be appreciated that the components of the valve manifold 90 may be coupled to the BOP stack 16 in a manner that eliminates some or all of the multiple hoses 92.

As noted above, the one or more fluid reservoirs 84 and the one or more pumps 86 of the closing unit system 70 may be used instead of accumulators that store high pressure accumulator hydraulic fluid. Instead, the closing unit system 70 may transfer the hydraulic fluid directly from the one or more fluid reservoirs 84 (e.g., which stores the hydraulic fluid at atmospheric pressure or at a first pressure) to the one or more pumps 86 when at least one of the one or more pumps 86 is adjusted from being off to being turned on in response to the input that indicates that at least one actuatable device of the BOP stack 16 should be adjusted. The closing unit system 70 may then transfer the hydraulic fluid (e.g., now at high pressure or at a second pressure that is higher than the first pressure) directly from the at least one of the one or more pumps 86 to the valve manifold 90 (e.g., there are no accumulators or fluid storage devices that store the hydraulic fluid at high pressure between the one or more pumps 86 and the BOP stack 16), which directs the hydraulic fluid to the one or more actuators of the BOP stack 16. Indeed, in some embodiments, the closing unit system 70 may be devoid of accumulators that store high pressure accumulator fluid.

However, as shown in FIG. 2, accumulators 140 (e.g., an accumulator stack) may be utilized to store and to provide high pressure accumulator fluid for certain actuators (e.g., only for some of the one or more actuators of the BOP stack 16), such as the valves for the choke line and/or the kill line associated with the BOP stack 16. In some embodiments, the accumulators 140 may be utilized to store and to provide the high pressure accumulator fluid to the one or more actuators of the BOP stack 16 as a backup to the hydraulic fluid that is provided via the one or more pumps 86 (e.g., in the case of all of the one or more pumps 86 failing or otherwise being unable to provide the hydraulic fluid to operate the BOP stack 16). The control panel 72 may control the valve manifold 90 to fluidly couple the accumulators 140 to the appropriate actuator(s) of the BOP stack 140 (e.g., based on the inputs to the control panel 72).

Figure 3:
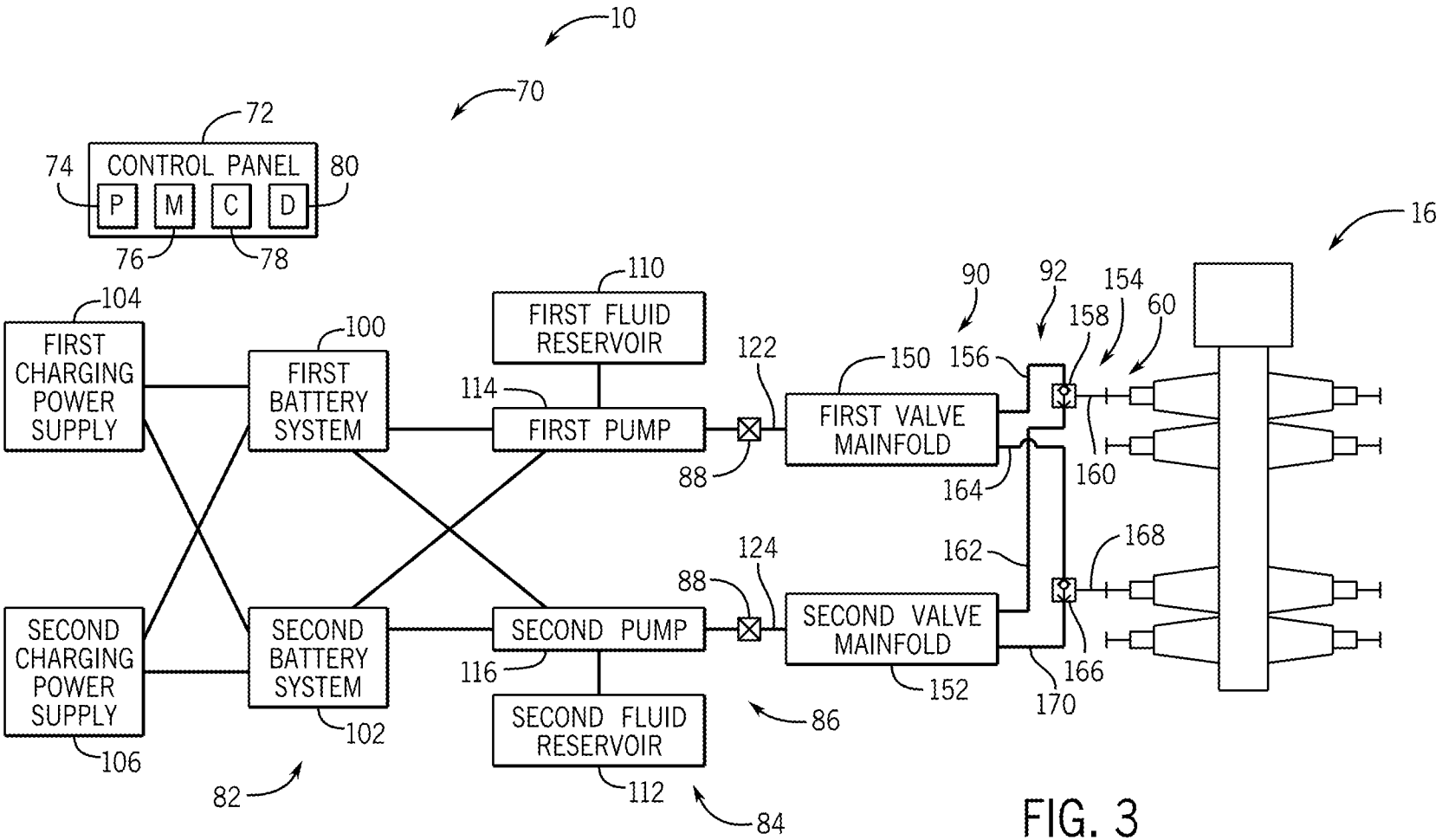
FIG. 3 is a schematic diagram of an embodiment of the closing unit system that may be used in the mineral extraction system of FIG. 1, wherein the closing unit system includes multiple valve manifolds.

FIG. 3 is a schematic diagram of an embodiment of the closing unit system 70, wherein the closing unit system 70 includes multiple valve manifolds 90. As shown, the closing unit system 70 may include the one or more valve manifolds 90, which may include a first valve manifold 150 and a second valve manifold 152. The first valve manifold 150 may be fluidly coupled to the first pump 114 via the first closing unit hose section 122, and the second valve manifold 152 may be fluidly coupled to the second pump 116 via the second closing unit hose section 124.

The first valve manifold 150 and the second valve manifold 152 may each be configured to direct the hydraulic fluid from their respective pump (e.g., from the first pump 114 and the second pump 116) toward the BOP stack 16. In some embodiments, multiple hoses 92 extend from the first valve manifold 150 and the second valve manifold 152 to one or more valves 154 (e.g., shuttle valves), which may each be associated or fluidly coupled to one of the actuators 60 of the BOP stack 16. Each valve 154 may enable the hydraulic fluid from the first valve manifold 152, the second valve manifold 154, or both to flow to the respective actuator 60 of the BOP stack 16 (e.g., based on the pressure of the hydraulic fluid from the first valve manifold 152 and the second valve manifold 154).

To facilitate discussion, the illustrated embodiment includes a few exemplary components. In particular, FIG. 3 illustrates the hoses 92 that include a first hose 156 extending from the first valve manifold 152 to a first valve 158 for a first actuator 160, a second hose 162 extending from the second valve manifold 154 to the first valve 158 for the first actuator 160, a third hose 164 extending from the first valve manifold 152 to a second valve 166 for a second actuator 168, and a fourth hose 170 extending from the second valve manifold 154 to the second valve 166 for the second actuator 168.

Thus, in operation, the first pump 114 may pump the hydraulic fluid through the first valve manifold 150, which may direct the fluid to one or more of the valves 154 for the actuator(s) 60 to be controlled at the BOP stack 16. Additionally or alternatively, the second pump 116 may pump the hydraulic fluid through the second valve manifold 150, which may direct the fluid to one or more of the valves 154 for the actuator(s) 60 to be controlled at the BOP stack 16. The one or more pumps 86, as well as the one or more power source systems 82, may be controlled as discussed above with respect to FIGS. 1 and 2. Thus, various combinations of components of the closing unit system 70 may be utilized to provide the hydraulic fluid to the one or more actuators 60 of the BOP stack 16.

It should be appreciated that additional hoses 92 and valves 154 may be provided in the closing unit system 70 (e.g., one valve 154 for each actuator 60 of the BOP stack 16 that is to be actuated via the hydraulic fluid). Additionally, the closing unit system 70 may include any of the components and features that are shown and described in detail above with respect to FIG. 2.

Figure 4:
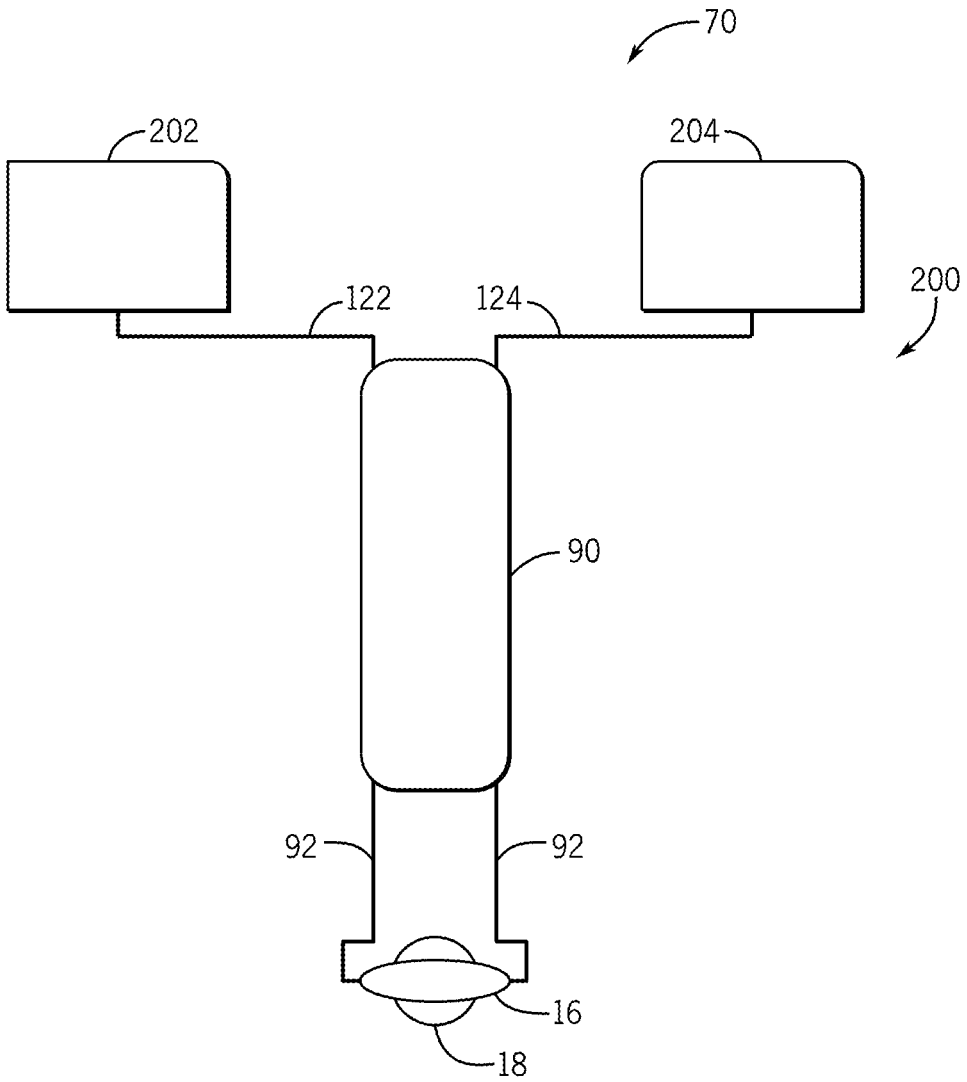
FIG. 4 is a schematic diagram of an embodiment of the closing unit system that may be used in the mineral extraction system of FIG. 1, wherein the closing unit system is positioned at a wellsite.

The disclosed embodiments may also provide advantages with respect to set up (e.g., installation) and/or maintenance operations (e.g., inspection, repair, and/or replacement). FIG. 4 is a block diagram of an embodiment of the closing unit system 70 and the BOP stack 16 positioned at a wellsite 200. As shown, the closing unit system 70 may include a first supply system 202, which may include the first fluid reservoir, the first pump, and/or the first battery system. In some embodiments, the first supply system 202 may include multiple fluid reservoirs, multiple first pumps, and/or multiple battery systems for redundancy within the first supply system 202. The first supply system 202 may be electrically coupled to one or more charging power supplies, such as the first charging power supply and/or the second charging power supply.

As shown, the closing unit system 70 may also include a second supply system 204, which may include the second fluid reservoir, the second pump, and/or the second battery system. In some embodiments, the second power supply system 204 may include multiple fluid reservoirs, multiple first pumps, and/or multiple battery systems for redundancy within the second supply system 204. The second supply system 204 may be electrically coupled to one or more charging power supplies, such as the first charging power supply and/or the second charging power supply. In some embodiments, the first battery system and the second battery system may be electrically coupled to the first pump (or multiple first pumps) of the first supply system 202 and to the second pump (or multiple second pumps) of the second supply system 204 to provide additional redundancy with respect to power supply for the pumps of the closing unit system 70.

The first supply system 202 and the second supply system 204 may output the hydraulic fluid at high pressure to the one or more valve manifolds 90 (e.g., through the first closing unit hose section 122 and the second closing unit hose section 124, respectively). As discussed above, the one or more valve manifolds 90 may include the single valve manifold (e.g., shared by the first supply system 202 and the second supply system 204) or multiple valve manifolds (e.g., one for the first supply system 202 and one for the second supply system 204). In some embodiments, the first supply system 202 may be supported on a first skid or trailer (e.g., of a first truck) and the second supply system 202 may be supported on a second skid or trailer (e.g., of a second truck). In some embodiments, a power take-off (PTO) of a truck associated with the trailer may be utilized to drive the pump of the corresponding supply system (e.g., the PTO of the first truck may drive the first pump of the first supply system 202; the PTO of the second truck may drive the second pump of the second supply system 204). The first supply system 202 and/or the second supply system may be assembled prior to delivery to the wellsite 200, and the one or more closing unit hoses (e.g., the first closing unit hose section 122 and the second closing unit hose section 124) may be coupled to the first supply system 202, the second supply system 204, and/or the one or more valve manifolds 90 at the wellsite 200 for efficient installation.

In some embodiments, the one or more valve manifolds 90 may be supported on a skid or trailer (e.g., of a third truck), and the hoses 92 may extend from the one or more valve manifolds 90 to the BOP stack 16 (e.g., to the actuators of the BOP stack or to shuttle valves associated with the actuators of the BOP stack). In some such cases, the one or more valve manifolds 90 may be assembled prior to delivery to the wellsite 200 and/or the BOP stack 16 may be assembled prior to the delivery to the wellsite 200. Then, the BOP stack 16 may be lifted and placed on the wellhead 18 as a unit for efficient installation. The hoses 92 may be coupled to the one or more valve manifolds 90 and/or to the BOP stack 16 before or after placement of the BOP stack 16 on the wellhead 18.

In some embodiments, the one or more valve manifolds 90 may be supported on the BOP stack 16. In some such cases, the one or more valve manifolds 90 and the BOP stack 16 may be assembled and/or coupled to one another prior to delivery to the wellsite 200 and/or prior to stacking the BOP stack 16 on the wellhead 18. Then, the one or more valve manifolds 90 and the BOP stack 16 may be lifted and placed on the wellhead 18 as a unit for efficient installation.

It should be appreciated that features shown and described with reference to FIGS. 1-4 may be combined in any suitable manner. Additionally, it should be appreciated that the closing unit system may include more than two supply systems, more than two battery systems, more than two fluid reservoirs, and/or more than two pumps to provide additional redundancy. The closing unit system may be configured to combine its components in various different combinations to reliably provide the hydraulic fluid to the BOP stack upon demand.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A closing unit system for a blowout preventer (BOP) stack, the closing unit system comprising:

a fluid reservoir that stores a fluid at atmospheric pressure;

at least one pump system comprising an electric motor coupled to a pump, wherein the at least one pump system is fluidly coupled to the fluid reservoir;

at least one power source, wherein the at least one pump system is electrically coupled to the at least one power source;

at least one valve fluidly coupled to the at least one pump system via a closing unit hose assembly; and one or more processors configured to:

receive at least one input indicative of an instruction to control an actuator associated with the BOP stack; and instruct the at least one power source to provide power to the at least one pump system to cause the at least one pump system to pump the fluid from the reservoir to the at least one valve in response to the at least one input, wherein the at least one valve is fluidly coupled to the actuator associated with the BOP stack.

2. The closing unit system of claim 1, wherein the at least one valve comprises a valve manifold.

3. The closing unit system of claim 1, wherein the actuator is configured to drive a shear ram of a shear ram BOP of the BOP stack to shear a conduit within the BOP stack.

4. The closing unit system of claim 1, wherein the closing unit system is devoid of an accumulator that stores and provides high pressure fluid to the actuator associated with the BOP stack.

5. The closing unit system of claim 1, wherein the closing unit system is devoid of an accumulator that stores and provides fluid to the actuator associated with the BOP stack at a pressure higher than atmospheric pressure.

6. The closing unit system of claim 1, wherein the actuator associated with the BOP stack is configured to control an actuatable device of the BOP stack.

7. The closing unit system of claim 6, wherein the actuatable device is at least one selected from the group consisting of: an annular BOP; a ram BOP; and a valve associated with a choke line or a kill line.

8. The closing unit system of claim 1, wherein the at least one power source comprises a battery.

9. A method of operating a closing unit system to control a blowout preventer (BOP) stack, the method comprising:

receiving, at one or more processors, an input indicative of an instruction to control an actuator associated with the BOP stack;

instructing, using the one or more processors, at least one power source to provide power to at least one pump system, wherein the at least one pump system comprises an electric motor coupled to a pump; and pumping, using the at least one pump system, a fluid from a fluid reservoir to at least one valve that is fluidly coupled to the actuator associated with the BOP stack, wherein the fluid reservoir stores the fluid at atmospheric pressure.

10. The method of claim 9, wherein the at least one valve comprises a valve manifold.

11. The method of claim 9, wherein the pumping step further comprises using the at least one pump system to output the fluid with a target parameter sufficient to control the actuator associated with the BOP stack.

12. The method of claim 9, wherein the closing unit system is devoid of an accumulator that stores high pressure accumulator fluid.

13. The method of claim 9, wherein the closing unit system is devoid of an accumulator that stores accumulator fluid at a pressure higher than the atmospheric pressure of the fluid stored in the fluid reservoir.

14. The method of claim 9, wherein the pumping step further comprises increasing a pressure of the fluid from the fluid reservoir for delivery to the BOP stack.

15. The method of claim 9, further comprising: using the actuator associated with the BOP stack to control an actuatable device of the BOP stack.

16. The method of claim 15, wherein the actuatable device is at least one selected from the group consisting of: an annular BOP; a ram BOP; and a valve associated with a choke line or a kill line.

17. The method of claim 9, further comprising: using the actuator to drive a shear ram of a shear ram BOP of the BOP stack to shear a conduit within the BOP stack.

* * * * *